United States Patent [19]

Schmid

[11] 4,136,728

[45] Jan. 30, 1979

[54] CONTINUOUS STEEL CASTING MOLD FOR BILLETS AND BLOOMS

[75] Inventor: Markus Schmid, Zürich, Switzerland

[73] Assignee: Concast AG, Zürich, Switzerland

[21] Appl. No.: 860,785

[22] Filed: Dec. 15, 1977

[30] Foreign Application Priority Data

Dec. 30, 1976 [CH] Switzerland ..... 16462/76

[51] Int. Cl.[2] ..... B22D 11/124

[52] U.S. Cl. ..... 164/444; 164/89

[58] Field of Search ..... 164/89, 417, 435, 443, 164/444, 441, 447, 448, 435, 443, 444

[56] References Cited

U.S. PATENT DOCUMENTS

| | | | |
|---|---|---|---|
| 2,284,503 | 5/1942 | Williams | 164/441 X |
| 2,895,190 | 7/1959 | Bungeroth et al. | 164/441 |
| 3,580,327 | 5/1971 | Khimich et al. | 164/435 |
| 3,882,924 | 5/1975 | Fujikawa | 164/444 X |

FOREIGN PATENT DOCUMENTS

| | | | |
|---|---|---|---|
| 51-20967 | 6/1976 | Japan | 164/441 |

*Primary Examiner*—Richard B. Lazarus
*Assistant Examiner*—John S. Brown
*Attorney, Agent, or Firm*—Werner W. Kleeman

[57] ABSTRACT

A continuous casting mold for casting strands, such as billets and blooms having a cross-sectional shape possessing corners, preferably a four-cornered cross-section, comprising an upper mold part and a lower mold part. Walls movable independently of one another of the lower mold part are movable about pivot shafts or equivalent structure arranged transversely with respect to the direction of travel of the cast strand and operatively connected with the upper mold part. The independently movable walls of the lower mold part can be shifted under the action of resilient elements, such as springs, towards the hollow cavity or mold compartment. The pivot shaft connected with each wall is arranged to be movable in a transverse direction with respect to the side of the wall associated with the hollow cavity or compartment of the mold.

5 Claims, 4 Drawing Figures

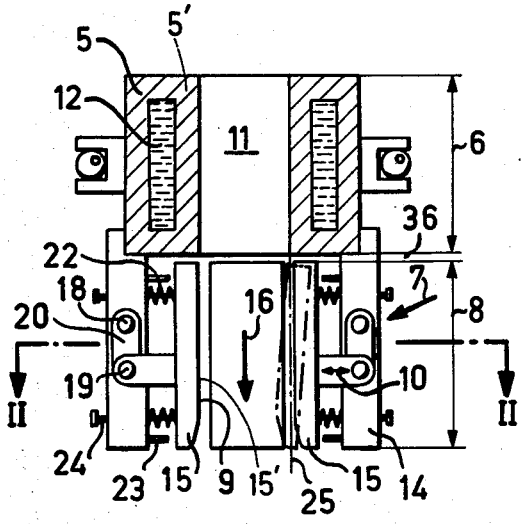
Fig. 1
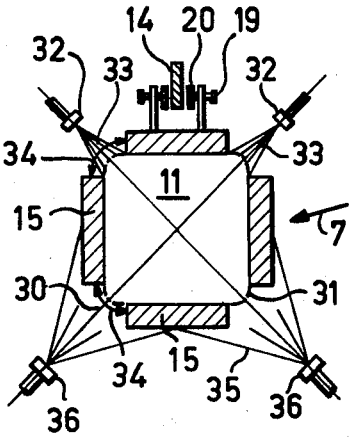
Fig. 2
Fig.3
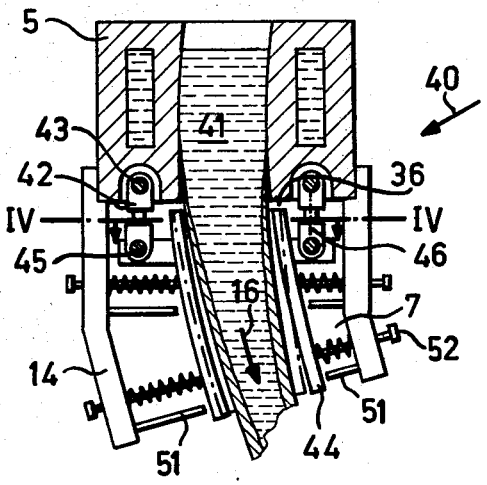
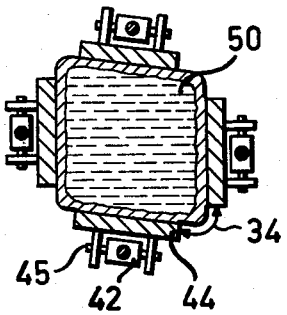
Fig. 4

CONTINUOUS STEEL CASTING MOLD FOR BILLETS AND BLOOMS

BACKGROUND OF THE INVENTION

The present invention relates to a new and improved construction of mold for a continuous casting installation, and in particular concerns a steel continuous casting mold for billets and blooms having a cross-sectional shape possessing corners, preferably a four-cornered cross-section, which mold is of the type comprising an upper mold part and a lower mold part, walls of the lower mold part which are movable independently of one another are arranged to be movable about pivot shafts or equivalent structure defining pivot axes which extend transversely with respect to the direction of travel of the cast strand and are operatively connected with the upper mold part, these mold walls being movable in the direction of the hollow cavity or compartment of the mold by the action of springs or other suitable resilient elements.

During the continuous casting of steel, especially at high casting speeds, it is of utmost importance for the strand upon departure from the continuous casting mold to have a uniform and as thick as possible strand shell or skin.

Due to contraction of the strand shell within the mold such shell or skin moves away from the mold walls, or depending upon the cross-section of the strand and the taper of the hollow cavity or compartment of the mold, produces an irregular contact of the strand at the mold walls over the circumference of such strand. Due to such irregular strand contact there is formed, especially at the lower part of the mold, a strand shell or skin which, at the exit end of the mold, especially at the regions of the corners, possesses different thicknesses and can lead to known flaws in the cast product, such as rhomboidness, fissures and so forth, and even can result in metal break-out.

There is already known to the art a continuous casting mold for casting strands having four corners, this mold comprising a mold upper part and a mold lower part. The mold lower part is constructed of four walls which can be moved independently of one another, each wall being movable about a pivot or tilt shaft arranged transversely with respect to the direction of travel of the strand and operatively connected with the upper mold part. By means of springs the walls are applied at a predetermined force in the direction of the hollow cavity or compartment of the mold. During a tilting movement of the wall, and viewed with respect to the direction of strand travel, there are produced different displacement paths for each point of the guide surface of the wall directed towards the strand. With changing cross-sectional dimensions of the strand at the outlet or exit end of the upper part of the mold, as such arise during a pour with changing casting speed and/or casting temperatures as well as irregular cooling due to shrinkage and so forth, there is not ensured with such prior art construction contact of the wall the strand over its entire length. Hence, there results irregular wear of the walls, irregular strand cooling with attendant strand defects, and irregular shell or skin thickness of the casting which can lead to rhomboidness of the cross-section of the cast strand, fissures, metal break-out and so forth. The aforementioned drawbacks preclude increasing the casting speed above the usual value of about three meters per minute for a cross-section of 100 × 100 mm$^2$.

SUMMARY OF THE INVENTION

Therefore, with the foregoing in mind, it is a primary object of the present invention to provide a new and improved construction of continuous casting mold which overcomes the aforementioned drawbacks of the prior art.

Another and more specific object of the present invention is directed to the construction of a new and improved continuous casting mold affording a substantially uniformly thick strand shell or skin at the outlet or exit end of the mold, allowing for greater casting speeds, improving the quality of the cast strand, and reducing the rate of metal break-out.

A further significant object of the present invention relates to an improved construction of continuous casting mold which is relatively simple in design, extremely reliable in operation, enables casting products with less likelihood of flaws or defects, produces a relatively uniform strand shell or skin at the exit end of the mold, and generally is not associated with the drawbacks and limitations of the prior art mold heretofore discussed.

Now in order to implement these and still further objects of the invention, which will become more readily apparent as the description proceeds, the mold construction of this development contemplates that the pivot shaft or equivalent pivot element connected with each wall is movably arranged in a transverse direction with respect to the side of the wall associated with or confronting the hollow cavity or compartment of the mold.

With the mold of this invention, and owing to the automatic adjustability of the walls at the surface of the strand independent of the dimensions and shape of the cross-section of the strand upon entry into the lower mold part, there is ensured for contact of such walls at the strand over the entire length of the lower mold part. As a result, there is afforded uniform cooling along the mold walls even in the presence of changing casting parameters, such as casting speed, casting temperature, composition of the cast metal, and so forth. The aforementioned strand flaws can be avoided and at the same time there can be obtained higher casting speeds, for instance, in the order of magnitude of four to six meters per minute with a strand cross-section of 100 × 100 mm$^2$ and a lower rate of metal break-out.

A further improvement as concerns metal break-out, casting speed and limiting of rhomboid shape of the strand at the upper mold part, can be realized in accordance with an additional feature of the invention which contemplates directing spray patterns from spray nozzles towards open corner regions of the hollow cavity of the mold in the lower mold part.

Depending upon the casting parameters prevailing during casting, the geometry of the hollow mold cavity and the degree of wear of the mold walls, there is present at the upper mold part, when casting rectangular strands, a tendency to form rhombic cross-sectional shapes of the strand. Hence, it is a further objective of the invention to cool strands having rhombic cross-section upon exit out of the upper mold part and entry into the lower mold part in a manner such and to support such strand in a manner such that, on the one hand, the undesirable rhombic shape of the strand does not increase and, on the other hand, there is simultaneously obtained optimum growth of the strand shell. These requirements can be fulfilled according to a further aspect of the invention in that the movably mounted pivot axis allows an additional pivotal movement of the wall within a predetermined degree about axes extending approximately parallel to the direction of strand travel. Due to this measure there is obtained an automatic accommodation of the mold walls also to strands having rhombic cross-section.

In order to cool the walls of the lower mold part such can be equipped with a primary cooling circuit. According to an advantageous construction of the invention which is quite simple, it is contemplated to direct the spray patterns simultaneously towards the open corner regions of the hollow cavity or compartment of the mold and at both walls adjoining the corner regions.

In order to ensure for a free, unhindered expansion of the upper mold part and the walls of the lower mold part during the casting operation and for preventing any friction along the parting plane between these two parts, it is advantageous to provide between the walls of the lower mold part and the upper mold part a gap extending transversely with respect to the direction of strand travel. If it is desired, the strand surface can additionally be cooled with spray water or other suitable coolant which is applied through such gap.

An advantageous mold plate suspension can be realized if the upper mold part has for each wall a stationarily arranged support or carrier and there are provided between such carrier and the wall links or guide levers which are articulated at one end at the wall and at the other end at the plate.

A further example of mounting or suspending the walls of the lower part of the mold, as contemplated by the invention, is to connect a link or guide lever in pendulum or oscillating fashion at the upper mold part and in cardanic fashion at the wall.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a vertical sectional view through a continous casting mold constructed according to the teachings of the present invention;

FIG. 2 is a sectional view taken substantially along the line II—II of FIG. 1;

FIG. 3 is a vertical sectional view through a further embodiment of a continuous casting mold constructed according to the invention; and FIG. 4 is a sectional view, taken substantially along the line IV—IV of the mold structure of FIG. 3.

DETAILED DESCRIPTION OF THE PREFERRED EMBODIMENTS

Describing now the drawings, the exemplary embodiment of continuous casting mold shown in FIGS. 1 and 2 can be advantageously used for casting steel and has a straight hollow cavity or compartment 11 for casting a billet. The mold will be seen to comprise an upper mold part 5 having a length indicated by reference character 6, and a lower mold part 7 having a length indicated by reference character 8. The upper mold part 5 is composed of fixedly arranged walls 5' equipped with an indirect cooling system 12 of conventional design. This upper mold part 5 can be, for instance, constituted from a copper pipe or composed of four copper plates. Carriers or supports 14 for the walls 15 of the lower mold part 7 are rigidly connected with the upper mold part 5. By means of pivot elements here shown as piovt shafts 18 and 19, defining pivot axes, arranged transversely with respect to the direction of travel 16 of the cast strand and essentially parallel to the related strand guide surfaces 15' of the walls 15, the aforesaid walls 15 which are movable independently of one another are connected with the mold upper part 5.

Each wall 15 is pivotable about the pivot shaft or pivot element 19 which is operatively connected with the upper mold part 5 and thus renders possible accomplishing an automatic change in the taper of the lower mold part 7. By means of two links or guide levers 20 connected at one end to the related mold wall 15 and at the other end at the carrier or support 14 and also by means of the pivot shafts 18, there are additionally movably arranged the pivot shafts 19 associated with each wall 15 for movement in a transverse direction 10 with respect to the side 9 of the wall 15 forming the hollow mold cavity or compartment 11. During casting there is undertaken a movement of the walls 15 only to the extent of shrinkage deviations of the strand shell which are governed by casting parameters, so that the pivoting or rocking about the axes 18 thru the small range practically constitutes a movement in the transverse direction 10 with respect to the strand travel direction 16. By means of resilient elements, particularly springs 22, there is produced a contact or application force at the strand. Stop or impact bolts 23 and 24 or equivalent limiting elements serve to limit the application path both in the direction of the strand as well as also away from the strand. This application or displacement path, as a general rule, amounts to 1–3 mm. The displacement path of the bolts 23 and 24 is adjusted such that the movably arranged pivot shafts 19 allow the walls 15 to carry out a movement past the alignment line 25 of the upper mold part 5 both in the direction towards and away from the strand.

The links or guide levers 20 arranged at both sides of each carrier or support 14, allow a limited independent displacement path of both links or guide levers 20 associated with each carrier or support 14 and the associated pivot shafts 19. The limited independent displacement path of each guide lever 20 allows for a limited accommodation of the related wall 15 to the changing shapes of the strand cross-section.

A gap 36 which extends transversely with respect to the direction of travel 16 of the strand is provided between the walls 15 of the lower mold part 7 and the walls 5' of the upper mold part 5.

Now in FIG. 2 there are arranged along extensions 30 of the diagonals of the rectangular strand cross-sectional surface 31 spray nozzles 32 whose flat spray patterns or jets 33 are directed towards open corner regions 34 of the lower mold part 7 of the hollow mold cavity or compartment 11. The width of the corner regions is constant in the direction of travel 16 of the strand. Instead of using spray nozzles 32 which produce a flat spray pattern 33, as shown in the upper half of the illustration of FIG. 2, it would also be possible to use spray nozzles 36 which produce, for instance, full conical-spray patterns 35 as shown in the lower half of FIG. 2. The full conical-spray patterns 35 can be simultaneously directed both into the open corner regions 34 of the hollow mold cavity or compartment 11 as well as towards both of the walls 15 adjoining the related corner region 34. The width of the open corner region can increase in the direction of travel 16 of the strand, so that the corners of the strand which oftentimes have a lesser shell thickness can be still further directly cooled, something which favorably affects the rate of metal break-out.

In FIGS. 3 and 4, the reference character 40 designates a mold having an arc-shaped or curved-type hollow mold cavity or compartment 41. Walls 44 of the lower mold part 7 are hingedly connected by the links or guide levers 42 and the pivot shafts 43 with the upper mold part 5. Each link or guide lever 42 can carry out a pendulum movement throughout a limited range or region. Each guide lever 42 is additionally rotatably mounted about a vertical pivot shaft or axis 46 between the pivot shaft 43 and a further pivot shaft 45. This rotatable mounting, together with the pivot shaft 45, forms a Cardan or universal suspension of the walls 41. The movably mounted pivot shaft 45, by virtue of the cardanic suspension allows an additional pivotal movement of the related wall about the axis 46 extending approximately parallel to the direction of travel 16 of the strand. In this way there is additionally possible, apart from an accommodation to the strand sectional shape and the taper of the mold, an automatic accommodation of such walls to rhombic-shaped strands 50, as shown in an exaggerated manner in FIG. 4. For limiting the three aforementioned wall movements within a predetermined degree or range there are provided the stop or impact bolts 51 and 52 at the support or carrier 14.

The selection of the size of the spring force for applying the walls 15, 44 against the shell of the cast strand, influences the friction between the strand which is forming and the mold walls. This friction affects the strand withdrawal force and also the wear of the walls 15, 44. It has been found that the spring force advantageously should be selected such that the wall is pressed with a specific contact pressure of 1.4–3 kp per $cm^3$ against the strand. Optimum values as concerns the cooling action, the wear, the strand withdrawal force and the support of the still partially soft strand shell or skin are obtained when the specific contact pressure of the walls at the strand amounts to between 1.6–2 kp per $cm^2$.

The length 6 of the upper mold part 5 can amount to, for instance 600–800 mm., the length 8 of the lower mold part 7 to between 200–400 mm. With direct cooling of the walls 15, 44 it is advantageous to use as the material for the walls, good heat conductive metals, such as copper, aluminum and so forth, and alloys of such metals.

The partially solidified strand 50 departing out of the mold is supported at a subsequently arranged strand support guide arrangement, in accordance with the prevailing requirements, for instance in a roller apron, and further cooled.

The described embodiments relate to a billet having four-cornered cross-sectional configuration. But, the invention can also be used to advantage with blooms, and for instance, the cross-section can be octagonal.

While there are shown and described present preferred embodiments of the invention, it is to be distinctly understood that the invention is not limited thereto, but may be otherwise variously embodied and practiced within the scope of the following claims.

Accordingly, I claim:

1. A continuous casting mold for casting steel billets and blooms having cornered cross-sectional configuration, especially four-cornered cross-sections, comprising:

an upper mold part having mold walls;

a lower mold part having mold walls;

said mold walls of said upper mold part and said lower mold part enclosing a mold compartment in which there is continuously cast a strand;

said mold walls of said lower mold part being movable independently of one another;

pivot elements connected with each of the independently movable walls of the lower mold part for enabling such walls to move about pivot axes defined by said pivot elements which are arranged transversely with respect to the direction of travel of the strand;

means for operatively connecting said pivot elements with said upper mold part;

resilient means for applying the independently movable walls of the lower mold part in the direction of the hollow mold compartment;

means movably arranging the pivot elements connected with each independently movable wall of the lower mold part for movement in a direction transverse to the side of the related wall of the lower mold part which confronts the hollow mold compartment; and said pivot elements mounted to be movable incorporate means enabling an additional pivotal movement of the related wall within a predetermined extent about an axis extending approximately parallel to the direction of travel of the strand.

2. The continuous casting mold as defined in claim 1, wherein said enabling means include:

a guide lever;

means for oscillatingly connecting said guide lever at the upper mold part; and means for providing a universal connection of said guide lever with the related wall of the lower mold part.

3. A continuous casting mold for casting steel billets and blooms having cornered cross-sectional configuration especially four-cornered cross-sections, comprising:

an upper mold part having mold walls;

a lower mold parting having mold walls;

said mold walls of said upper mold part and said lower mold part enclosing a mold compartment in which there is continuously cast a strand;

said mold walls of said lower mold part being movable independently of one another;

pivot elements connected with each of the independently movable walls of the lower mold part for enabling such walls to move about pivot axes defined by said pivot elements which are arranged transversely with respect to the direction of travel of the strand;

means for operatively connecting said pivot elements with said upper mold part;

resilient means for applying the independently movable walls of the lower mold part in the direction of the hollow mold compartment;

means movably arranging the pivot elements connected with each independently movable wall of the lower mold part for movement in a direction transverse to the side of the related wall of the lower mold part which confronts the hollow mold compartment;

said operatively connecting means includes a stationarily arranged support provided at the upper mold part for each independently movable wall of the lower mold part;

said movably arranging means including guide lever means provided between each such support and the related wall of the lower mold part; and said movably arranging means hingedly connecting one end of said guide lever means with the related wall and the other end of said guide lever means with said support.

4. The continuous casting mold as defined in claim 3, wherein:

the walls of the lower mold part are arranged such as to form open corner regions for the hollow mold compartment; and spray nozzle means for spraying flat spray patterns towards the open corner regions of the lower mold part of the hollow mold compartment.

5. The continuous casting mold as defined in claim 4, wherein:

said spray nozzle means are oriented such that the spray patterns emanating therefrom are simultaneously directed towards the open corner regions of the hollow mold compartment and at both walls adjoining each such corner region.

* * * * *